US006230459B1

(12) United States Patent
Jeffers et al.

(10) Patent No.: US 6,230,459 B1
(45) Date of Patent: May 15, 2001

(54) WALL START FOR PANEL SYSTEMS

(75) Inventors: Robert E. Jeffers; Michael D. Elsholz, both of Grand Rapids; Richard S. Hand, Holland; Karl J. Mead; Todd M. Ostrander, both of Grand Rapids; Fredrick M. Brickley, Flint, all of MI (US)

(73) Assignee: Steelcase Development Inc., Grand Rapids, MI (US)

( * ) Notice: Subject to any disclaimer, the term of this patent is extended or adjusted under 35 U.S.C. 154(b) by 0 days.

(21) Appl. No.: 09/205,459

(22) Filed: Dec. 4, 1998

(51) Int. Cl.[7] ..... E04B 2/78

(52) U.S. Cl. ..... 52/239; 52/481.2; 52/775; 52/781

(58) Field of Search ..... 52/238.1, 239, 52/243, 481.2, 36.1, 36.6, 775, 781, 764, 582.2

(56) References Cited

U.S. PATENT DOCUMENTS

| | | | | |
|---|---|---|---|---|
| Re. 27,215 | | 11/1971 | Propst et al. . | |
| 3,722,157 | | 3/1973 | Prokop . | |
| 4,416,093 | | 11/1983 | Salkeld et al. . | |
| 4,497,148 | | 2/1985 | Lopez . | |
| 4,545,168 | | 10/1985 | Dalton, Jr. . | |
| 4,571,907 | | 2/1986 | DeFouw et al. . | |
| 4,612,744 | | 9/1986 | Shamash . | |
| 4,716,692 | | 1/1988 | Harper et al. . | |
| 4,761,922 | | 8/1988 | Black . | |
| 4,809,476 | | 3/1989 | Satchell . | |
| 4,884,375 | | 12/1989 | Wendt . | |
| 4,928,465 | * | 5/1990 | Del Castillo Von Haucke | 52/239 |
| 4,996,811 | | 3/1991 | Dull et al. . | |
| 5,058,347 | | 10/1991 | Schuelke et al. . | |
| 5,117,599 | | 6/1992 | Voss . | |
| 5,150,554 | | 9/1992 | Quinlan, Jr. et al. . | |
| 5,219,406 | | 6/1993 | Raz . | |
| 5,287,666 | | 2/1994 | Frascaroli et al. . | |
| 5,377,466 | | 1/1995 | Insalaco et al. . | |
| 5,406,760 | | 4/1995 | Edwards . | |
| 5,715,633 | | 2/1998 | Raz et al. . | |
| 5,802,789 | | 9/1998 | Goodman et al. . | |
| 5,899,035 | * | 5/1999 | Waalkes et al. | 52/239 |
| 6,009,675 | * | 1/2000 | Waalkes | 52/239 |
| 6,009,676 | * | 1/2000 | Feldpausch et al. | 52/239 |
| 6,058,667 | * | 5/2000 | MacDonald et al. | 52/239 |

FOREIGN PATENT DOCUMENTS

| | | | | |
|---|---|---|---|---|
| 8304294 | * | 7/1985 | (NL) | 52/238.1 |

* cited by examiner

*Primary Examiner*—Laura A. Callo
(74) *Attorney, Agent, or Firm*—Price, Heneveld, Cooper, DeWitt & Litton

(57) ABSTRACT

A wall start panel for knock-down portable partition systems of the type having a plurality of panels, each having standard width posts interconnected by structural members in a spaced-apart relationship to define a standard panel width. The wall start panel includes at least one structural member and a standard width post having a unitary construction and including a connection port. The standard width post also has opposite side faces defining a standard post width therebetween. The wall start panel further includes a wall start post having a connection port and having opposite side faces defining a width therebetween substantially less than the standard post width. The structural member spans between and releasably interconnects the standard width and wall start posts in a spaced-apart relationship. The wall start panel has a substantially standard panel width, such that the wall start post can be secured to an existing wall without use of a trim piece to close off the wall start panel.

25 Claims, 8 Drawing Sheets

WALL START FOR PANEL SYSTEMS

CROSS-REFERENCES TO RELATED APPLICATIONS

The present application is related to commonly assigned, U.S. Pat. application Ser. No. 08/914,664, filed Aug. 19, 1997, entitled KNOCK-DOWN PORTABLE PARTITION SYSTEM now issued U.S. Pat. No. 6,009,675; commonly assigned, U.S. patent application Ser. No. 08/856,995, filed May 15, 1997, entitled KNOCK-DOWN PORTABLE PARTITION SYSTEM now issued U.S. Pat. No. 5,899,035; commonly assigned, U.S. patent application Ser. No. 09/060,913, filed Apr. 15, 1998, entitled KNOCK-DOWN PORTABLE PARTITION SYSTEM now issued U.S. Pat. No. 6,098,358; and commonly assigned, U.S. patent application Ser. No. 09/060,911 entitled MODULAR WINDOW FOR PARTITION PANELS, filed Apr. 15, 1998 now issued U.S. Pat. No. 6,058,667, each of which is hereby incorporated by reference.

BACKGROUND OF THE INVENTION

The present invention relates to office partition panel systems, and in particular to a wall start that connects a partition panel to an existing wall in an off-module configuration.

The efficient use of building floor space is an ever-growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable or portable partition panels that are detachably interconnected to partition off the open spaces into individual workstations and/or offices. Such partition panels have sufficient structural strength to receive hang-on furniture units, such as work surfaces, overhead cabinets, shelves, etc., and are generally known in the office furniture industry as "systems furniture." In addition, such partition panels have an acoustical, sound-absorbing configuration to promote a quiet, pleasant work environment.

Numerous partition panel systems have been developed for dividing office workspaces into smaller areas. Partition panel systems, like those disclosed in U.S. Pat. No. 4,996,811, utilize prefabricated rectangular partition panel members that have a unitary rigid perimeter frame formed by top, bottom, and end channels that are welded to one another. Decorative cover panels are fastened to opposite sides of the perimeter frame. Each perimeter frame member has a rectangular shape and is fabricated and shipped as a single unit, often with the decorative cover panels pre-fastened to the frame. During installation, the prefabricated perimeter frame of each panel member is fastened to the perimeter frame of an adjacent panel member along the vertical edges thereof, either directly or by a separate fastener post. Each partition panel member includes two height adjustable feet or glides along the bottom edge of each panel member, with one glide being located adjacent each vertical panel edge. Since there are two vertical frame members at each panel joint, this type of panel construction results in structural redundancy. In addition, since each glide must be properly adjusted for height, this configuration requires adjustment of both glides at each panel joint during assembly. Furthermore, although longer panels typically have a lower cost per unit length, longer panels are difficult to handle, which places a practical limit on the size of the partition panel member that can be shipped and installed as a prefabricated unit.

Other partition panel systems, like that disclosed in U.S. Pat. No. 5,150,554, utilize prefabricated rectangular partition panel members having a unitary perimeter frame that attaches to a post member along each vertical panel edge. Although this type of design may have a single glide at each post, each panel-to-post connection has at least two vertical structural members. Since only a single vertical member is needed to provide support and height adjustment, this type of system has redundant structure. In addition, the rectangular partition panel members are manufactured and shipped as a unit, limiting the size of the partition panel members that can be used.

Other office divider systems, like that disclosed in U.S. Pat. No. 5,406,760, utilize vertical posts and horizontal beams wherein each post attaches to an adjacent post along adjacent vertical edges. Since each post is attached directly to an adjacent post, this configuration also has redundant vertical structural members and glides.

Other office panel dividers, like that disclosed in U.S. Pat. Nos. 5,287,666 and 5,219,406, have multiple posts and beams with connector members that hold a pair of beams to adjacent posts. This arrangement has two horizontal beams in a side-by-side relationship at each height location, and also has two vertical posts attached directly together in either a back-to-back or side-by-side relationship. Thus, there is redundancy in both the post and the beam structures. In addition, connector pieces are required to attach the beams to the posts.

Special bracket arrangements have been developed to connect partition panel systems to existing architectural walls and are commonly referred to as "wall starts." Available wall start brackets position the side edge of the partition panel some distance away from the architectural wall and may require specially fabricated and/or fitted cover panels and trim adjacent the architectural wall. Because the wall start bracket adds width that is not a multiple of a standard panel width, the resulting partition panel has an overall length that is non-standard. Consequently, the partition panel that is connected to the architectural wall and adjoining panels may be misaligned relative to the other partition panels in the system, making it difficult to integrate the non-standard panels with the other panels in the system to provide the desired workspace dimensions. Accordingly, there is a need for a wall start for a partition panel that provides a standard panel width, and also permits quick and easy connection to various types of existing dividers and walls, without requiring custom-fit cover panels and trim.

SUMMARY OF THE PRESENT INVENTION

One aspect of the present invention is to provide a wall start panel for knock-down portable partition systems of the type having a plurality of panels, each having standard width posts interconnected by structural members in a spaced-apart relationship to define a standard panel width. The wall start panel includes at least one structural member and a standard width post having a unitary construction and including a connection port. The standard width post also has opposite side faces defining a standard post width therebetween. The wall start panel further includes a wall start post having a connection port and having opposite side faces defining a width therebetween substantially less than the standard post width. The structural member spans between and releasably interconnects the standard width and wall start posts in a spaced-apart relationship. The wall start panel has a substantially standard panel width, such that the wall start post can be secured to an existing wall without use of a trim piece to close off the wall start panel.

Another aspect of the present invention is a wall start panel for knock-down portable partition systems of the type having a plurality of standard width panels with standard width cover panels mounted thereon. The wall start panel includes a wall start frame defining a first side edge shaped for connection to an existing wall and an opposite side edge. A standard width cover panel is secured to the wall start frame and covers at least a portion of the same. The cover panel defines a side edge extending vertically adjacent the existing wall, such that a trim piece is not required along the side edge. The wall start frame includes a standard width post having upper and lower ends and having opposite side faces defining a standard post width therebetween. The standard width post also has at least two beam connection ports. The wall start frame further includes a wall start post configured to be secured to an existing wall and having at least two beam connection ports. Upper and lower beams extend generally horizontally between the standard width and wall start posts and releasably interconnect the posts adjacent the connection ports. The wall start post has opposite side faces defining a width therebetween substantially less than the standard post width, such that the wall start panel has a substantially standard width when secured to an existing wall.

Another aspect of the present invention is a wall start post for knock-down portable partition systems of the type having a plurality of standard width panels including a wall start panel of the type having a standard width post and a pair of beams releasably connected to the standard width post. The standard width post has a unitary construction with opposite side faces defining a standard width post therebetween. The wall start post is shaped to secure the wall start partition panel to an existing wall, and has a first side face with at least two beam connection ports thereon for releasably connecting to the beams to form a wall start panel. A second side face of the wall start post is shaped to abut an existing wall. The side faces of the wall start post define a width therebetween that is substantially less than that of the standard width post, such that the wall start panel has a substantially standard width when the wall start post is secured to an existing wall.

These and other features, objects, and advantages of the present invention will become apparent upon reading the following description thereof together with reference to the accompanying drawings.

DETAILED DESCRIPTION OF THE PREFERRED EMBODIMENTS

Figure 1:
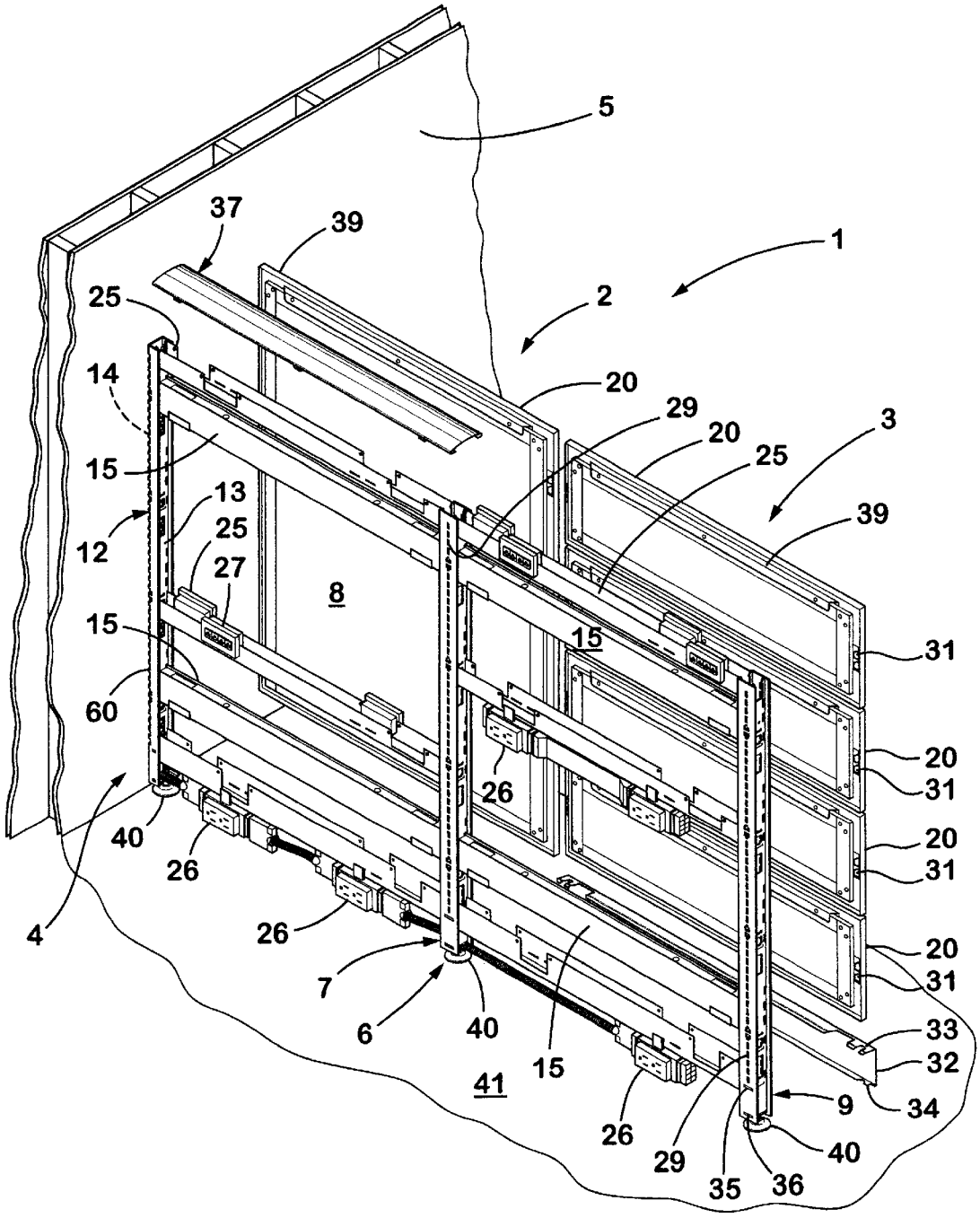
FIG. 1 is a partially exploded, perspective view of a wall start post and knock-down partition system connected to an existing wall.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a wall start for knock-down portable partition systems embodying the present invention, which is particularly designed for use in open office plans and other similar settings and environments. In the illustrated example, the wall start 1 includes a knock-down portable partition panel 2 for partition systems of the type having a plurality of standard width panels 3. The partition panel 2 has a first side edge 4 connectable to an existing wall 5 in an off-module configuration. The partition panel 2 also includes an opposite side edge 6 that can be connected to a standard width panel 3. The partition panel 2 includes a rigid panel frame 7 having a central portion 8. At least one cover panel 20 is connected to the rigid panel frame 7 and covers at least a portion of the central portion 8 of the rigid panel frame 7.

Figure 2:
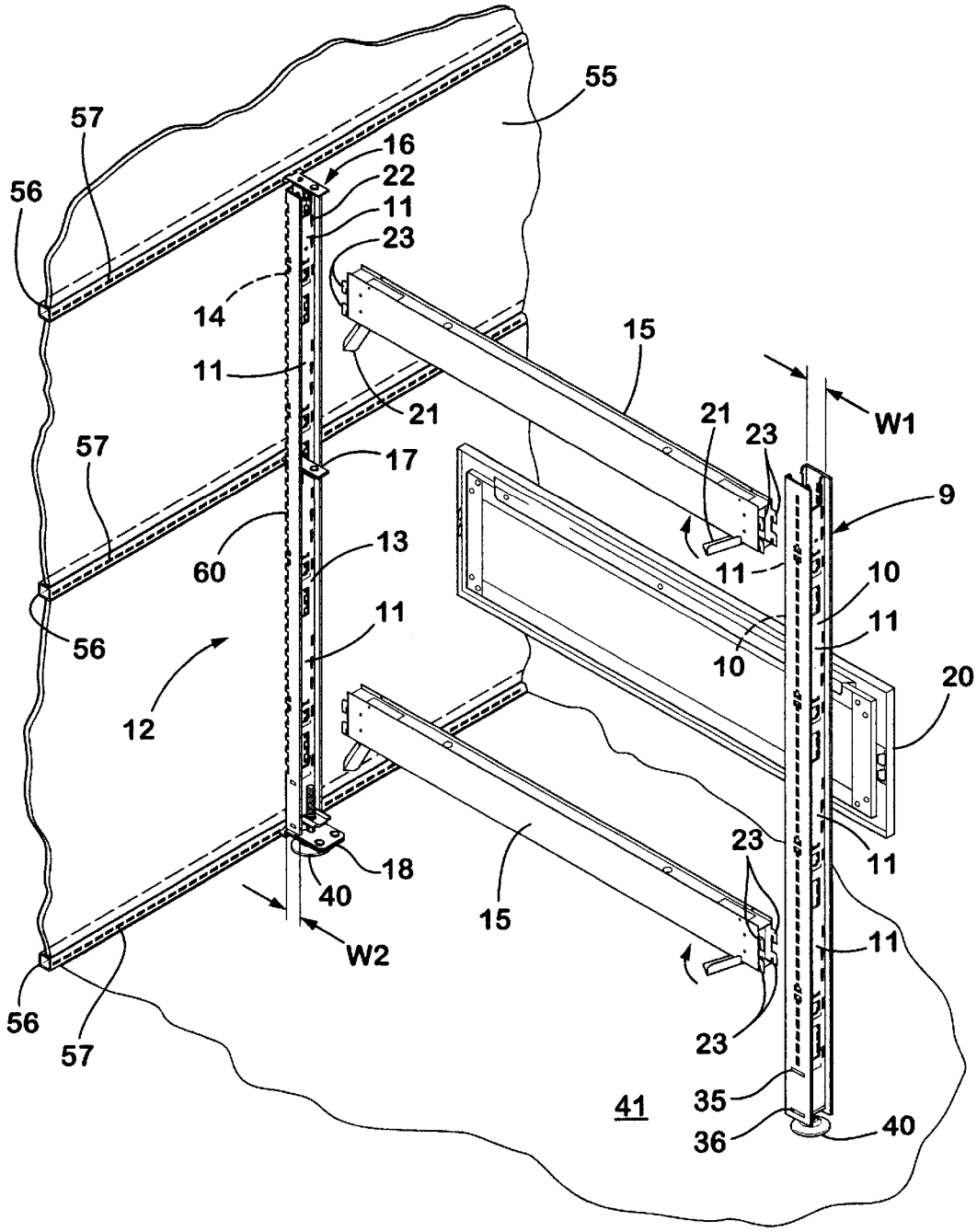
FIG. 2 is an exploded, perspective view of a wall start post and partition panel with brackets attaching the wall start post to the horizontal rows of slots of an existing wall.

With further reference to FIG. 2, the rigid panel frame 7 includes a standard width post 9 having a unitary construction with opposite side faces 10 defining a standard post width "W1" therebetween. The opposite side faces 10 have at least two beam connection ports 11. The rigid panel frame 7 also includes a wall start post 12 having first and second opposite side faces 13 and 14 defining a width "W2" therebetween. Width "W2" is substantially less than the standard post width "W1," such that the opposite side edge 6 is spaced-apart from the existing wall 5 at substantially a standard panel width. The first side face 13 of the wall start post 12 has at least two beam connection ports 11. Upper and lower beams 15 extend generally horizontally between the standard width and wall start posts 9 and 12 and releasably interconnect the posts adjacent the connection ports 11. The second side face 14 of the wall start post 12 defines the first side edge 4 of the partition panel 2. The side face 14 has at least a portion defining a contour corresponding to the existing wall 5. The wall start post 12 further includes at least one wall connector such as upper, intermediate, or lower hooked brackets 16–18 (FIG. 2), described in more detail below. Alternatively, the connector may comprise an architectural wall connector bracket 19 (FIGS. 3 and 4) or other suitable connector. The wall connector brackets secure the wall start post 12 to the existing wall 5 in an off-module configuration without requiring additional trim, spacers, or other specially made hardware.

Figure 6:
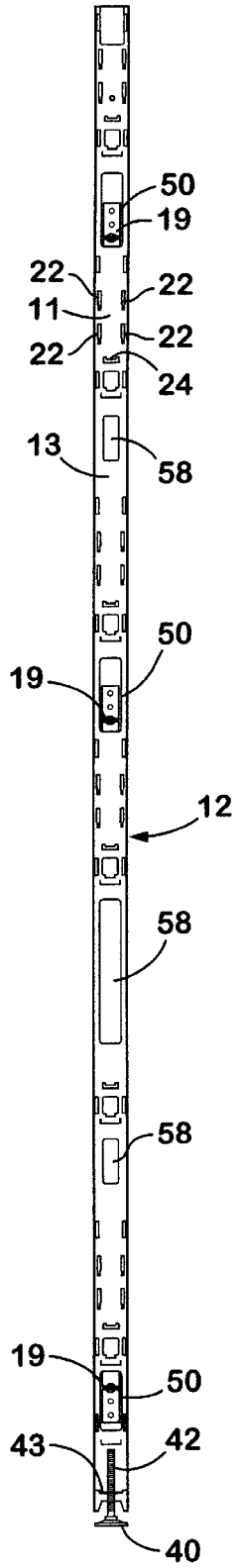
FIG. 6 is a front elevational view of the wall start post of FIG. 3.
Figure 7:
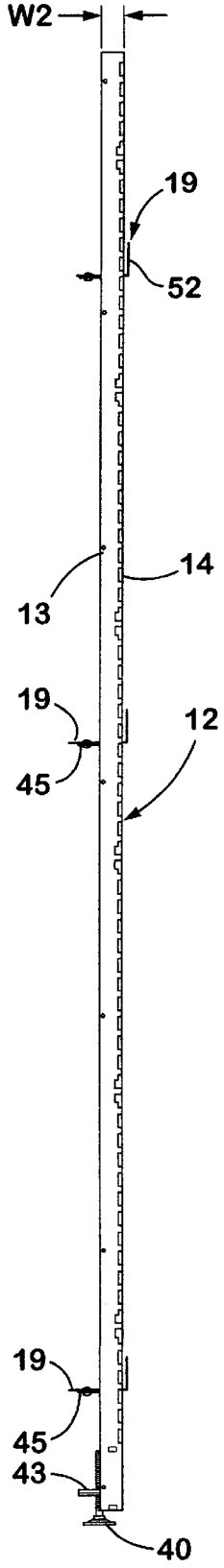
FIG. 7 is a side elevational view of the wall start post of FIG. 3.
Figure 8:
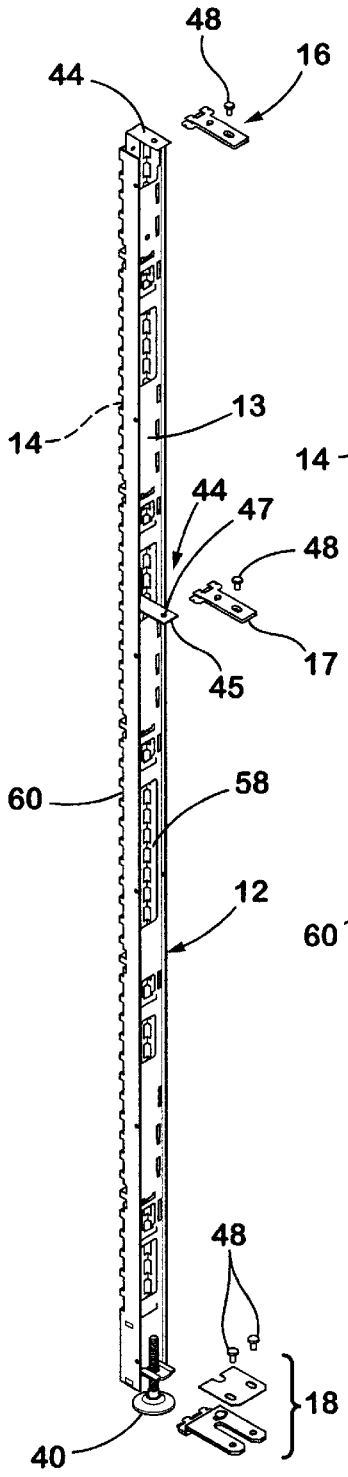
FIG. 8 is a partially exploded, perspective view of the wall start post of FIG. 2.
Figure 9:
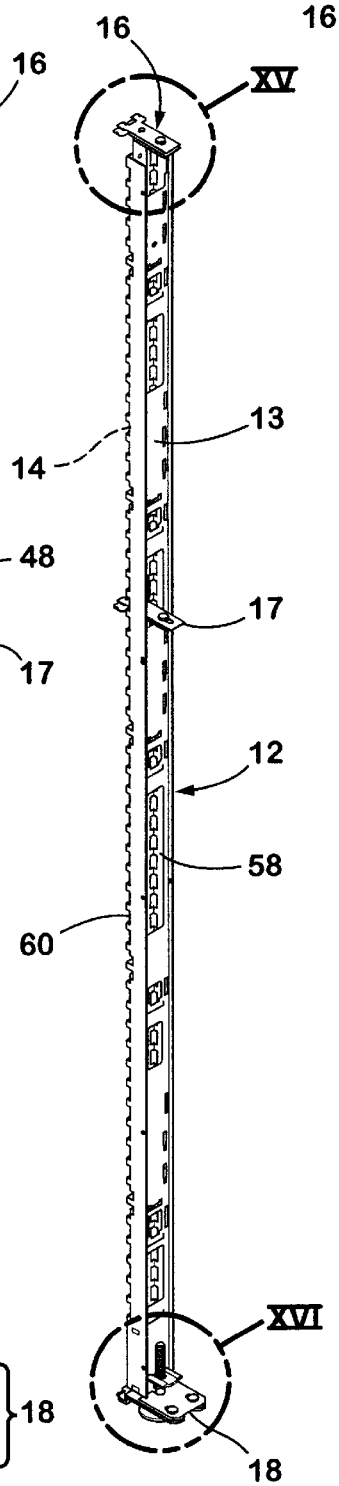
FIG. 9 is a perspective view of the wall start post of FIG. 2.
Figure 10:
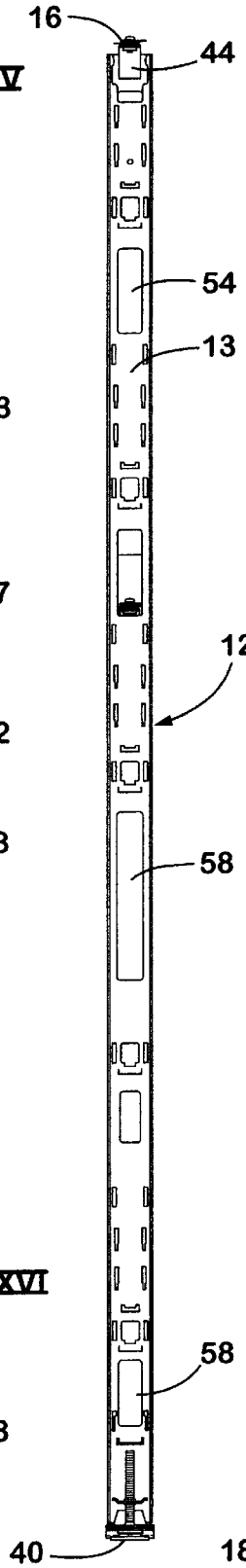
FIG. 10 is a front elevational view of the wall start post of FIG. 2.
Figure 11:
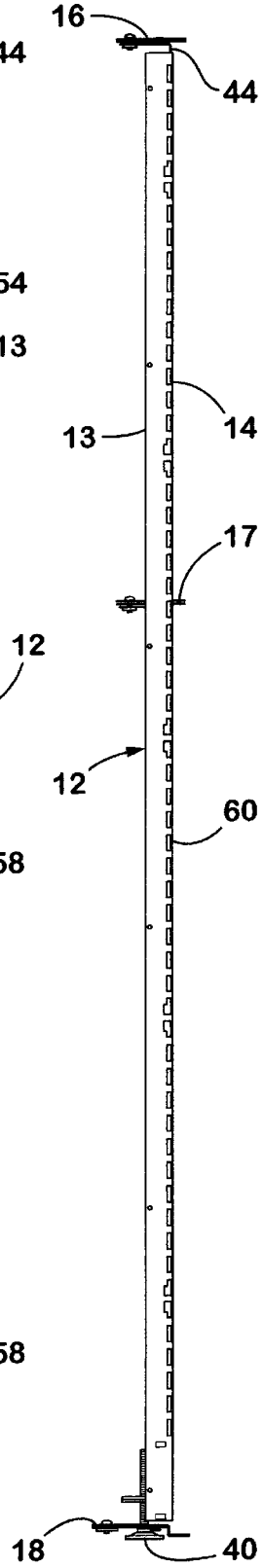
FIG. 11 is a side elevational view of the wall start post of FIG. 2.

Examples of standard width posts 9 and beams 15 are described in detail in the above-identified U.S. Pat. Nos. 6,009,675; 5,899,035; 6,098,358; 6,058,667, and and hence, will not be described in detail herein. With reference to FIG. 2, beams 15 are constructed from tubular steel and include quick-disconnect connectors, such as wedges 21. The wedges 21 are rotatably mounted on the beams 15. Each beam connection port 11 includes four vertical slots 22 (see also FIG. 6) that receive hooks located on the ends of the beams 15. Wedge 21 is then rotated to engage opening 24, thereby ensuring that hooks 23 remain engaged with slots 22. Utility troughs 25 extend between the posts 9 and/or 12, and receive lay-in wiring. Utility troughs 25 also provide for mounting of power receptacles 26 and/or communications receptacles 27. Wall start posts 9 and 12 each utilize the same connecting arrangement for cover panels, beams, utility troughs, and related components, such that additional, specially fabricated cover panels, trim, or other components are not required.

Figure 14:
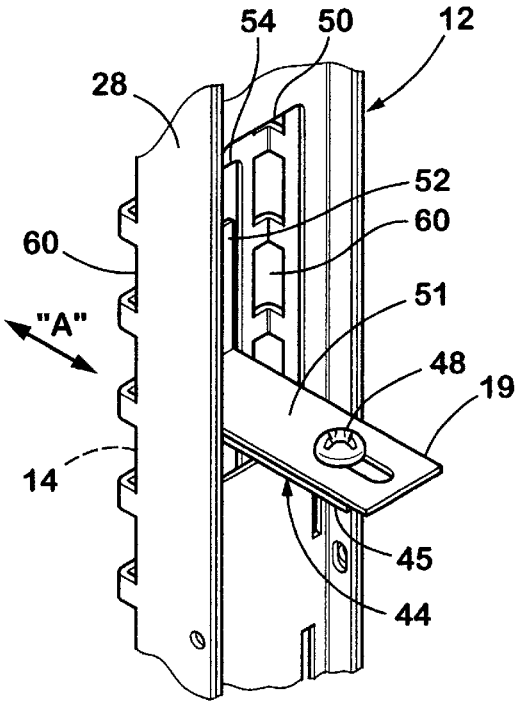
FIG. 14 is a fragmentary, perspective view of the wall start post of FIG. 3, showing the brackets of FIGS. 12 and 13.

The standard width posts 9 have front faces 28 with a vertical row of openings, such as slots 29, that receive hooks of hang-on accessory units (not shown), such as binder bins, worksurfaces, and the like. Clip-receiving openings 30 receive clips 31 of cover panels 20 for support of the cover panels. Base cover 32 includes integrally formed upper and lower clips 33 and 34 that are received in upper and lower openings 35 and 36 to removably secure the base cover 32 along the base of the partition. A top cap 37 includes a plurality of clips 38 that secure the top cap 37 along upper edge 39 of cover panels 20. Posts 9 and 12 each include a glide 40 for supporting the post on an existing floor surface 41. Each glide 40 includes a threaded portion 42 (FIG. 6) that is received in a threaded plate 43 adjacent the lower end of the post. As best seen in FIG. 14, wall start post 12 includes a vertical row of slots 60 located at the corner formed by the junction of the second opposite side face 14 and front faces 28. Slots 60 are positioned directly adjacent the existing wall when the wall start post 12 is in the installed position.

If width "W2" of wall start post 12 is one-half width "W1" of standard width post 9, standard width post 9 will be positioned at a standard panel width from the existing wall. The illustrated wall start post 12 includes vertical slots 60 on front faces 28 adjacent second side face 14 of post 12. Because slots 60 have the same width as slots 29, width "W2" of wall start post 12 is slightly greater than one-half width "W1" of a standard width post 9. Accordingly, although standard width post 9 is not precisely positioned at a standard panel width because width "W2" is about one-half width "W1", panel misalignment or "creep" due to the wall start is substantially eliminated.

In contrast to prior systems having two side-by-side vertical frame members that are directly interconnected, standard width post 9 has a unitary construction with beams interconnected to the same post 9 on opposite side faces. Similarly, wall start post 12 may also have a unitary construction with a first side face 13 providing beam connection ports 11, and a second side face 14 that closely fits against and abuts the existing wall. Posts 9 and 12 have a tubular steel construction with a quadrilateral plan shape.

Figure 12:
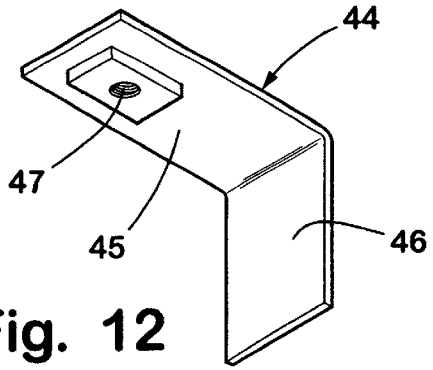
FIG. 12 is a perspective view of a connector bracket used for the architectural wall start post, and the wall start post for existing walls having a horizontal row of slots.
Figure 13:
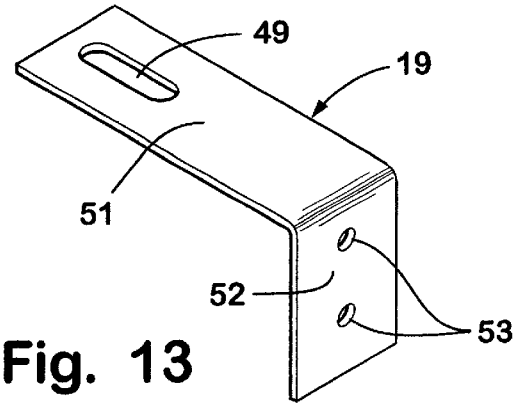
FIG. 13 is an architectural wall connector bracket for the wall start post of FIG. 3.

With reference to FIG. 12, each wall start post 12 includes at least one bracket 44 with a horizontally extending tab portion 45 and a vertical leg 46 that is welded or otherwise secured to the post 12. Threaded fasteners 48 secure either an architectural wall connector bracket 19 (FIGS. 4–7) or an intermediate hooked bracket 17 (FIGS. 8–11) to the horizontal tab 45. Wall start post 12 includes a plurality of openings 58 that permit routing of power and/or communications cabling through post 12 and the existing wall. With further reference to FIGS. 13 and 14, each architectural wall connector bracket 19 includes an elongated slot 49 that receives threaded fastener 48. First opposite side face 13 of post 12 includes a clearance opening 50, such that vertical leg 46 of bracket 44 can be welded to the inner surface of the second opposite side face 14 of post 12, with tab 45 extending horizontally through opening 50. Architectural wall connector bracket 19 is generally L-shaped and includes a horizontal leg 51 and vertical leg 52. Vertical leg 52 includes a pair of clearance holes 53 that receive a conventional anchor bolt or other conventional fastener for securing connector bracket 19 to an existing wall, such as an architectural wall, or other type of wall capable of receiving fasteners for securing bracket 19. Slot 49 permits bracket 19 to be slid horizontally in the direction of the arrow "A" (FIG. 14) to account for variations in the surface contour of the existing wall and permit vertical positioning of post 12. After adjustment of the bracket 19 to the proper position, threaded fastener 18 secures bracket 19 to the threaded opening 47 of bracket 44. The second opposite side face 14 has a large, rectangular clearance opening 54 permitting vertical leg 52 of connector bracket 19 to pass through second side face 14 as required to secure bracket 19 to an existing wall, while accounting for variations in the contour of the wall surface. A plurality of brackets 44 and connector brackets 19 are provided for securing the wall start post 12 to an existing architectural wall or other wall. The wall start post 12 illustrated in FIGS. 4–7 has upper, intermediate, and lower brackets 19. However, the number of brackets required can be varied, depending upon the height of the partition system 1 and wall start post 12, or other factors relating to the particular application.

In another preferred embodiment (not shown), clearance holes are provided in wall start post 12. Conventional fasteners extend through the clearance holes and secure post 12 directly to an architectural wall. Suitable fasteners for anchoring to dry wall, concrete block, or the like are selected depending on the construction of the existing wall. This arrangement replaces the connector bracket 19 described above.

Another type of existing wall 55, illustrated in FIG. 2, includes a plurality of horizontal frame members 56 having horizontal rows of slots 57. An example of an existing wall 55 of the type illustrated in FIG. 2 is described in detail in U.S. Pat. No. 5,802,789, the entire contents of which are hereby incorporated by reference. To configure wall start post 12 for use with the existing wall 55, a plurality of brackets 44 are welded to the wall start post 12 in a similar manner as described above, except that brackets 44 are positioned at heights corresponding to the horizontal rows of slots 57 in the existing wall 55.

Figure 19:
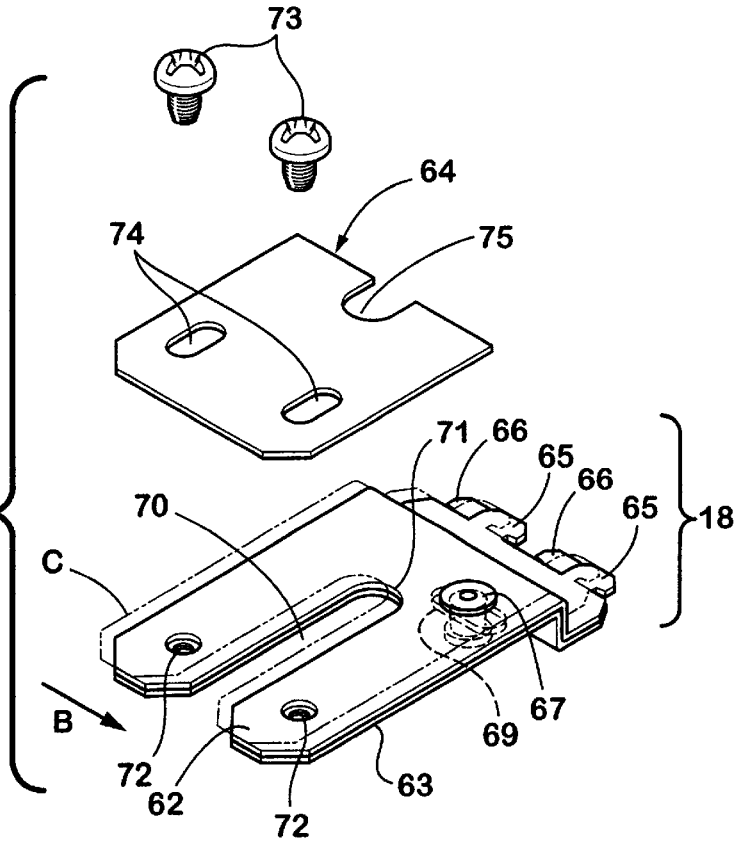
FIG. 19 is an exploded, perspective view of the bracket of FIG. 16.

With reference to FIGS. 16–19, lower bracket 18 includes a retainer plate 64 and an upper hooked member 62 that is slidably connected to a lower hooked member 63. Upper hooked member 62 includes a pair of hooks 65 that are oriented in a first horizontal direction, and lower hooked member 63 has a pair of hooks 66 that are oriented in an opposite horizontal direction. A connector, such as rivet 67, extends through a circular opening 68 in upper hooked member 62 and through an elongated slot 69 in lower hooked member 63 to slidably interconnect upper and lower hooked members 62 and 63. Upper and lower hooked members 62 and 63 each have an elongated slot 70 with a radiused end 71. During installation of lower hooked member 63, upper hooked member 62 is shifted sideways relative to lower hooked member 63 (opposite the arrow "B", FIG. 19) to the position "C" shown in phantom (FIG. 19). In position "C", hooks 65 are positioned substantially above, and aligned with, hooks 66, such that the hooks 65 and 66 can be inserted into the horizontal slots 57 of a horizontal frame member 56 of the wall 55 illustrated in FIG. 2. Upper hooked member 62 is then shifted horizontally in the direction of the arrow "B" (FIG. 19), thereby locking hooks 65 and 66 into the slots 57. The glide 40 is then inserted into the elongated slot 70, and retainer plate 64 is secured to threaded openings 72 of lower hooked member 63 by means of conventional threaded fasteners 73 extending through clearance openings 74 in plate 64. Retainer plate 64 has a radiused cutout 75 that forms a circular opening 76 (FIG. 17) with the radiused cutouts 71 of upper and lower hooked members 62 and 63 when installed. Radiused cutouts 71 and 75 fit snugly around the glide 40 (FIG. 16), yet provide sufficient clearance to permit the glide 40 to be vertically adjusted for support of the wall start post 12. Preferably, lower hooked member 63 has a plate 77 (FIG. 18) welded, or otherwise secured thereto, to provide additional material for forming threads 72. Openings 74 in retainer plate 64 are preferably slotted to permit retainer plate 64 to be adjustably secured to upper and lower hooked members 62 and 63, thereby providing a secure connection to the glide 40.

Figure 15:
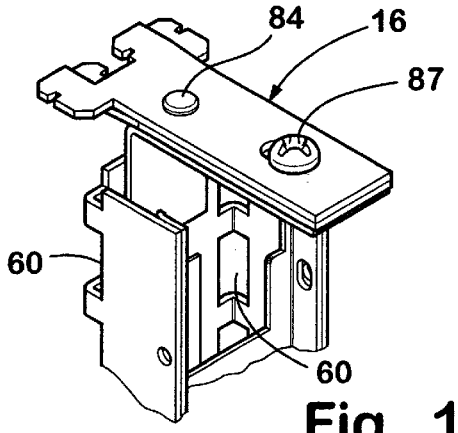
FIG. 15 is a fragmentary, perspective view of the upper connector bracket of FIG. 2.
Figure 16:
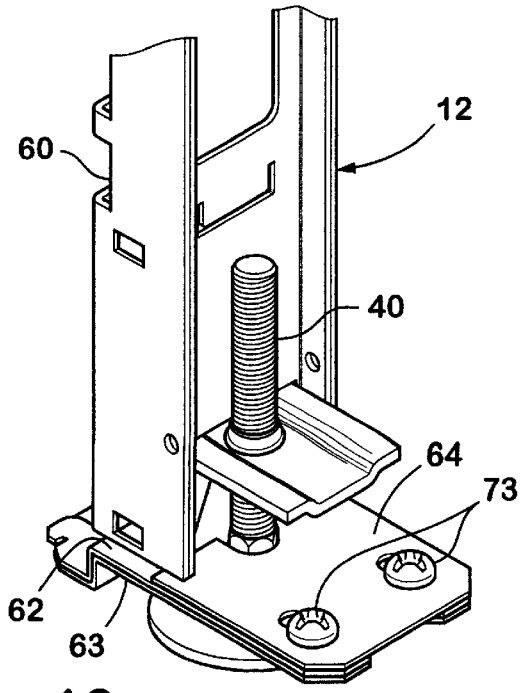
FIG. 16 is a fragmentary, perspective view of the lower connector bracket of FIG. 2.
Figure 17:
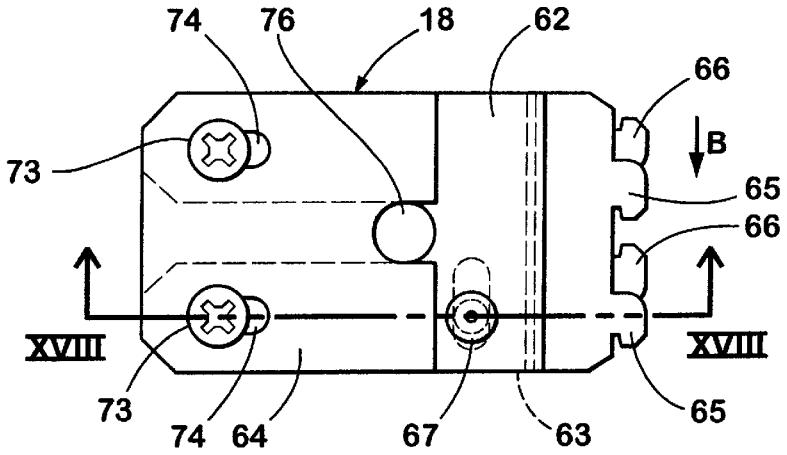
FIG. 17 is a top elevational view of the lower connector bracket of FIG. 16.
Figure 18:
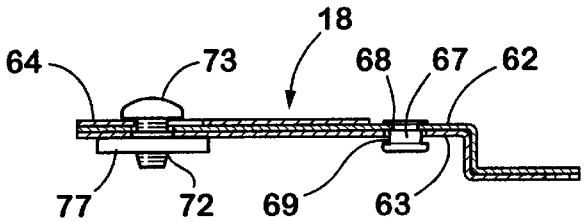
FIG. 18 is a cross-sectional view of the lower connector bracket of FIG. 17 taken along the line XVIII—XVIII, FIG. 17.
Figure 20:
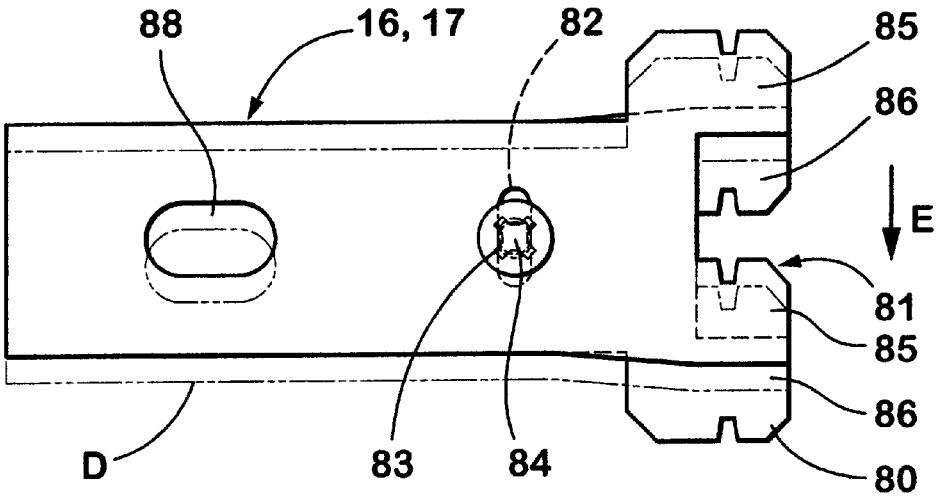
FIG. 20 is a top plan view of the bracket of FIG. 15.
Figure 21:
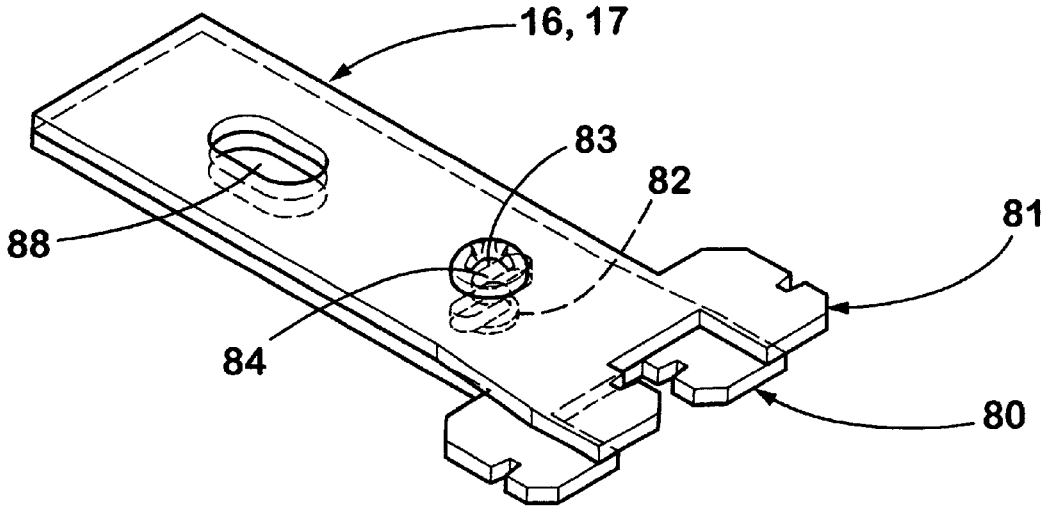
FIG. 21 is a perspective view of the bracket of FIG. 15.

Upper hooked bracket 16 and intermediate hooked bracket 17 are substantially similar and are illustrated in FIGS. 20 and 21. Hooked brackets 16 and 17 include a lower hooked plate member 80 and upper hooked plate member 81. Lower hooked member 80 includes an elongated slot 82, and upper hooked member 81 includes a clearance opening 83. A rivet or other suitable connector 84 extends through elongated slot 82 and clearance opening 83 to slidably interconnect lower and upper hooked members 80 and 81. During installation, upper hooked member 81 is first shifted in the direction of the arrow "E" (FIG. 20) relative to lower hooked member 80, such that the hooks 85 in upper hooked member 81 are positioned substantially above, and aligned with, the hooks 86 of lower hooked member 80 in the position "D" (FIG. 20). Hooks 85 and 86 are then inserted into horizontal slots 57 of horizontal frame members 56 of an existing wall 55 (FIG. 2). The upper hooked member 81 is then shifted opposite arrow "E" relative to the lower hooked member 80 (FIG. 20), thereby locking the bracket 16 (or 17) to the horizontal slots 57. A conventional threaded fastener or bolt 87 (FIG. 15) is then inserted through the slotted opening 88 in the upper and lower hooked members 81 and 80 and into the threaded opening 47 of a bracket 44 at either the upper or intermediate positions. Opening 88 is preferably elongated to permit horizontal adjustment of post 12. When post 12 is properly positioned, threaded fastener 87 is tightened, thereby securing post 12 to existing wall 55.

Figure 3:
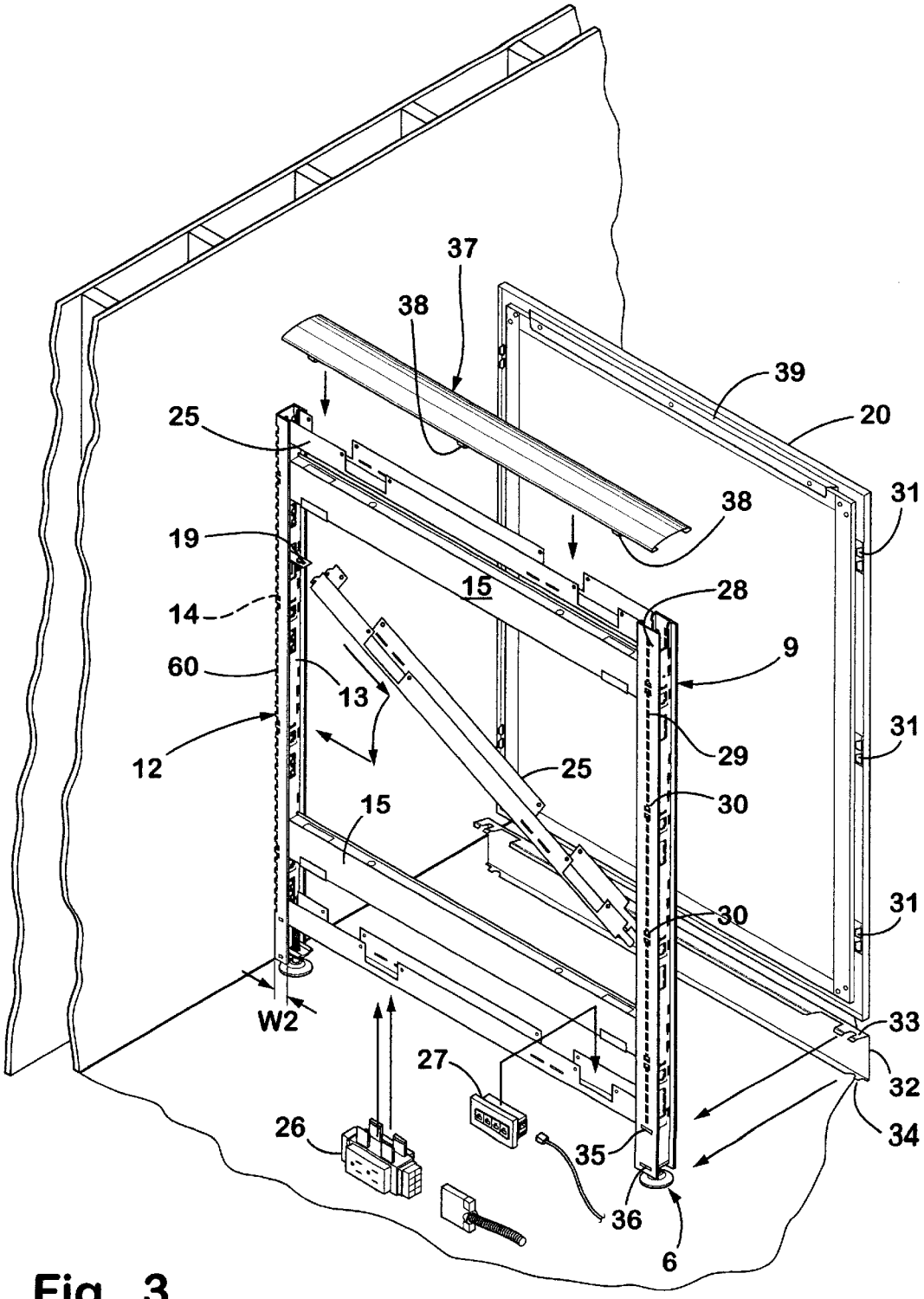
FIG. 3 is a partially exploded view of a partition panel including a wall start post that is secured to an existing architectural wall.
Figure 4:
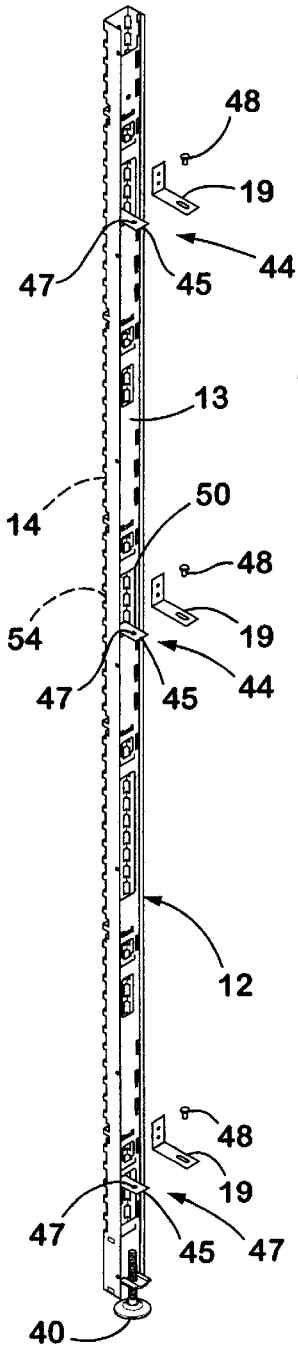
FIG. 4 is an exploded, perspective view of the architectural wall start post of FIG. 3.
Figure 5:
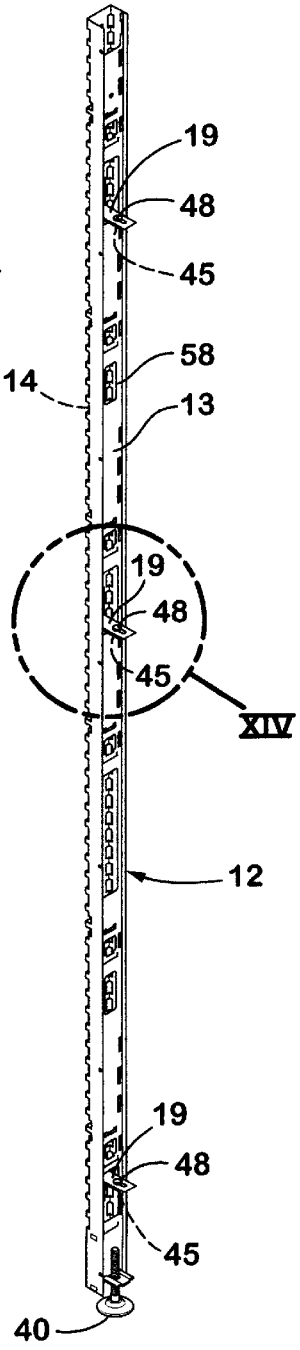
FIG. 5 is a perspective view of the wall start post of FIG. 3.

After securing the wall start post 12 to the existing architectural wall of FIG. 3 or to the existing divider or wall 55 of FIG. 2, beams 15 and a standard width post 9 are assembled to the wall start post 12 to form a wall start panel frame. One or more standard width panels 3 (FIG. 1) can then be assembled to wall panel frame 7 in an adjoining relationship thereto as required for a particular installation.

It will become apparent to those skilled in the art that various modifications to the preferred embodiment of the invention as described herein can be made without departing from the spirit or scope of the invention as defined by the appended claims.

What is claimed is:

1. A wall start panel for knock-down partition systems of the type having a plurality of panels, each having standard width posts interconnected by structural members in a spaced-apart relationship to define a standard panel width, said wall start panel comprising:

at least one structural member;

a standard width post having a unitary construction and including a connection port, said standard width post having opposite side faces defining a standard post width therebetween;

a wall start post having a connection port and having opposite side faces defining a width therebetween substantially less than said standard post width, said structural member spanning between and releasably interconnecting said standard width and wall start posts in a spaced-apart relationship, said wall start panel having a substantially standard panel width, such that said wall start post can be secured to an existing wall without use of a trim piece to close off said wall start panel;

a prefabricated cover panel extending between said posts and closing off said wall start panel, said cover panel having a prefabricated standard width that does not require custom fitting of said cover panel during installation; and wherein said at least one structural member comprises upper and lower beams extending between and rigidly interconnecting said standard width and wall start posts in a spaced-apart relationship.

2. A wall start panel as set forth in claim 1, wherein:

said standard width post and said wall start post each define opposite front faces having apertures; and said cover panel defining opposite side edges and having connectors thereon releasably engaging said apertures to support said cover panel on said wall start panel.

3. A wall start panel as set forth in claim 2, wherein:

said wall start panel includes a bracket having hooks for connecting said wall start posts to slots of an existing wall.

4. A wall start panel as set forth in claim 3, wherein:

said wall start post includes a threaded glide engaging a lower end of said post to adjustably support said wall start post on a floor surface;

said hooks extend horizontally for connection to a horizontal row of slots of an existing wall; and said bracket defines a U-shaped slot, an elongate portion of said threaded glide extending through said U-shaped slot and positioning said post relative to said bracket.

5. A wall start panel for knock-down partition systems of the type having a plurality of panels, each having standard width posts interconnected by structural members in a spaced-apart relationship to define a standard panel width, said wall start panel comprising;

at least one structural member;

a standard width post having a unitary construction and including a connection port, said standard width post having opposite side faces defining a standard post width therebetween;

a wall start post having a connection port and having opposite side faces defining a width therebetween substantially less than said standard post width, said structural member spanning between and releasably interconnecting said standard width and wall start posts in a spaced-apart relationship, said wall start panel having a substantially standard panel width, such that said wall start post can be secured to an existing wall without use of a trim piece to close off said wall start panel; and a bracket adjustably interconnecting the wall start post to the existing wall.

6. A wall start panel for knock-down partition systems of the type having a plurality of panels, each having standard width posts interconnected by structural members in a spaced-apart relationship to define a standard panel width, said wall start panel comprising:

at least one structural member;

a standard width post having a unitary construction and including a connection port, said standard width post having opposite side faces defining a standard post width therebetween;

a wall start post having a connection port and having opposite side faces defining a width therebetween substantially less than said standard post width, said structural member spanning between and releasably interconnecting said standard width and wall start posts in a spaced-apart relationship, said wall start panel having a substantially standard panel width, such that said wall start post can be secured to an existing wall without use of a trim piece to close off said wall start panel; and wherein;

said wall start post defines opposite front faces, each having a vertical row of slots for supporting hang-on accessory units, said vertical rows of slots disposed directly adjacent said second side face of said wall start post.

7. A wall start panel as set forth in claim 6, wherein:

said at least one structural member comprises upper and lower beams extending between and rigidly interconnecting said standard width and wall start posts, and wherein:

said beams define opposite ends including quick-disconnect connectors rigidly interconnecting with said beam connection ports of said standard width post and said wall start post.

8. A wall start panel for knock-down partition systems of the type having a plurality of panels, each having standard width posts interconnected by structural members in a spaced-apart relationship to define a standard panel width, said wall start panel comprising;

at least one structural member;

a standard width post having a unitary construction and including a connection port, said standard width post having opposite side faces defining a standard post width therebetween;

a wall start post having a connection port and having opposite side faces defining a width therebetween substantially less than said standard post width, said structural member spanning between and releasably interconnecting said standard width and wall start posts in a spaced-apart relationship, said wall start panel having a substantially standard panel width, such that said wall start post can be secured to an existing wall without use of a trim piece to close off said wall start panel; and wherein;

said wall start post includes a horizontally extending tab and a wall connector bracket shaped for securing to an existing wall, said wall connector bracket attached to said tab in a manner permitting horizontal adjustment of said wall connector bracket to account for variations in the surface contour of the existing wall.

9. A wall start panel for knock-down portable partition systems of the type having a plurality of standard width panels with standard width cover panels mounted thereon, said wall start panel comprising:

a wall start frame defining a first side edge shaped for connection to an existing wall and an opposite side edge;

a standard width cover panel secured to said wall start frame and covering at least a portion of the same, said cover panel defining a side edge adapted to extend vertically adjacent an existing wall such that a trim piece is not required along said side edge;

said wall start frame comprising:

a standard width post having upper and lower ends and having opposite side faces defining a standard post width therebetween, said standard width post having at least two beam connection ports;

a wall start post configured to be secured to an existing wall and having at least two beam connection ports;

upper and lower beams extending generally horizontally between said standard width and wall start posts and releasably interconnecting the posts adjacent said connection ports; and said wall start post having opposite side faces defining a width therebetween substantially less than said standard post width, such that said wall start panel has a substantially standard width when secured to an existing wall.

10. A wall start panel as set forth in claim 9, wherein:

said wall start post has a width of about half the width of said standard post.

11. A wall start panel as set forth in claim 10, including:

a wall connector bracket for securing said wall start post to an existing wall.

12. A wall start panel as set forth in claim 11, wherein:

said wall start post defines opposite front faces having vertical rows of openings for supporting hang-on accessory units.

13. A wall start panel as set forth in claim 12, wherein:

said vertical rows of openings on said wall start post are disposed along corners defined by the intersection of said side faces and said front faces.

14. A wall start panel as set forth in claim 13, wherein:

said wall connector bracket includes hooks for connecting to openings in an existing wall.

15. A wall start panel as set forth in claim 14, wherein:

said hooks extend horizontally for connecting to a horizontal row of slots in an existing wall.

16. A wall start panel as set forth in claim 13, wherein:

said wall connector bracket has a vertically extending web with at least one opening therethrough for reception of a fastener to secure said wall connector bracket to the existing wall.

17. A wall start panel as set forth in claim 11, wherein:

said wall start post includes at least one horizontally extending tab, said connector bracket adjustably attached to said horizontal tab to account for variations in the contour of the existing wall.

18. A wall start panel as set forth in claim 17, including:

a fastener; and wherein said horizontally-extending tab has a slot therethrough, and said connector bracket has an opening therethrough; and said fastener extending through said opening in said connector bracket and said slot in said horizontally extending tab to adjustably secure said connector bracket to said horizontally extending tab.

19. A wall start post for knock-down portable partition systems of the type having a plurality of standard width panels and including a wall start panel of the type having a standard width post and a pair of beams releasably connected to the standard width post, the standard width post having a unitary construction with opposite side faces defining a standard width post therebetween; and wherein said wall start post is shaped to secure the wall start partition panel to an existing wall, and having a first side face with at least two beam connection ports thereon for releasably connecting to the beams to form a wall start panel, and a second side face shaped to abut an existing wall;

said side faces of said wall start post configured for assembly with a wall start panel adapted to be secured to an existing wall; and a wall connector bracket for securing the wall start post to an existing wall.

20. A wall start post as set forth in claim 19, wherein:

said first and second side faces are substantially parallel, such that said wall start panel is adapted to form a T-shaped plan configuration with an existing wall when secured thereto.

21. A wall start post as set forth in claim 19, wherein:

said wall start post defines opposite front faces having vertical rows of openings for supporting hang-on accessory units.

22. A wall start post as set forth in claim 21, wherein:

said wall connector bracket includes hooks for connecting to openings in an existing wall.

23. A wall start post as set forth in claim 22, wherein:

said hooks extend horizontally for connecting to a horizontal row of slots in an existing wall.

24. A wall start post as set forth in claim 19, wherein:

said wall connector bracket has a vertically extending wall with at least one opening therethrough for reception of a fastener to secure said wall connector bracket to the existing wall.

25. A wall start post as set forth in claim 19, wherein:

said wall start post includes at least one horizontally extending tab, said connector bracket adjustably attached to said horizontal tab to account for variations in the contour of the existing wall.

* * * * *

UNITED STATES PATENT AND TRADEMARK OFFICE

CERTIFICATE OF CORRECTION

PATENT NO. : 6,230,459 B1
DATED : May 15, 2001
INVENTOR(S) : Robert E. Jeffers et al.

It is certified that error appears in the above-identified patent and that said Letters Patent is hereby corrected as shown below:

Column 5,
Line 28, "6,058,667, and" should be -- and 6,058,667, --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*